US005526324A

United States Patent [19]

Cushman

[11] Patent Number: 5,526,324

[45] Date of Patent: Jun. 11, 1996

[54] ACOUSTIC ABSORPTION AND DAMPING MATERIAL WITH PIEZOELECTRIC ENERGY DISSIPATION

[75] Inventor: William B. Cushman, Pensacola, Fla.

[73] Assignee: Poiesis Research, Inc., Pensacola, Fla.

[21] Appl. No.: 515,580

[22] Filed: Aug. 16, 1995

[51] Int. Cl.[6] ..... H04K 3/00

[52] U.S. Cl. ..... 367/1; 181/294

[58] Field of Search ..... 367/1; 181/294

[56] References Cited

U.S. PATENT DOCUMENTS

| | | | |
|---|---|---|---|
| 3,515,910 | 6/1970 | Fritz et al. | 367/1 |
| 3,614,992 | 10/1971 | Whitehouse et al. | 367/1 |
| 4,628,490 | 12/1986 | Kramer et al. | 367/1 |
| 5,400,296 | 3/1995 | Cushman et al. | 362/1 |

OTHER PUBLICATIONS

Hartmann & Javzynski "Ultrasonic hysteresis absorption in polymers" J. Appl. Phys. vol. 43, No. 11, Nov. 1972, 4304–4312.

Japan New Materials Report, May–Jun. 1995, p. 9.

*Primary Examiner*—J. Woodrow Eldred

[57] ABSTRACT

Acoustic absorption and vibration damping materials are produced by mixing electrically conductive particles or strands into a piezoelectric matrix material. The electrically conductive particles or strands act as small localized electrical short-circuits within the matrix material and effectively dissipate the electric charges produced by piezoelectric effect from the pressure of acoustic or vibrational energy as heat. All energy thus converted into heat is subtracted from the original acoustic or vibrational energy, resulting in acoustic absorption and/or vibration damping.

9 Claims, 1 Drawing Sheet

ACOUSTIC ABSORPTION AND DAMPING MATERIAL WITH PIEZOELECTRIC ENERGY DISSIPATION

BACKGROUND OF THE INVENTION

1. Field of the Invention

This invention relates to acoustic absorption and damping materials, and more particularly, to acoustic absorption and damping materials that utilize a piezoelectric phenomenon to convert mechanical energy into electrical energy and to subsequently dissipate the converted energy as heat.

2. Description of Related Art

Absorbing or damping unwanted acoustic or vibrational energy involves converting that energy into another form, usually heat. At the molecular level, the only distinction between heat energy and acoustic or vibrational energy is the randomness of the vector directions of molecular displacements. Acoustic and vibrational energy is highly correlated with large numbers of molecules displacing at the same time and in the same direction. Heat in a particular object may well have the same or more energy than propagating acoustic or vibrational energy, but the motion of the molecules is random with the mean molecular displacement at any given location being near zero.

Two primary techniques are available for randomizing the vector directions of the molecules in a matrix material propagating acoustic or vibrational energy. Cushman, et al. (U.S. Pat. No. 5,400,296) teach the use of two or more species of particles with differing characteristic impedances in a matrix material to promote random internal reflections at boundaries within the matrix material and the subsequent increase in probability that phase cancellation at adjacent or nearby locales can take place. Single particle species may also be used in this manner, but with less effect. Phase cancellation effectively randomizes the vector direction of molecular movement where it occurs. A second approach involves the careful choice of materials that exhibit a high degree of internal hysteresis. This internal hysteresis is thought to be caused by metastable molecular energy levels within the material. Propagating acoustic or vibrational energy may boost a particular molecule into a higher energy level, thus subtracting that energy from propagating energy, where the molecule remains for some time before randomly returning to its original energy level. For a discussion of this effect see Hartmann and Jarzynski, "*Ultrasonic hysteresis absorption in polymers,*" *J. Appl. Phys.*, Vol. 43, No. 11, November 1972, 4304–4312.

Instead of randomizing molecular displacements to dissipate propagating acoustic or vibrational energy, some of this energy can be removed by converting the mechanical energy of sound or vibration into electrical energy utilizing the piezoelectric effect. A piezoelectric material such as polyvinylidene fluoride (PVDF) may be polarized and a coating of a conductive material such as aluminum applied to produce a piezoelectric transducer that will convert acoustic energy into electric energy, thus facilitating removal of converted energy from the system. This approach is reported in a recent issue of the Japan New Materials Report (May–June, 1995, p 9). In this report acoustic energy reductions of up to 90% are claimed in material specimens only 10 to 30 microns thick. However, the need to polarize the material and apply conductive electrodes to tap off the electrical energy produced limits the usefulness of this technique.

SUMMARY OF THE INVENTION

Accordingly, the object of the instant invention is to provide an improved acoustic absorption and vibration damping material utilizing the piezoelectric effect that may be injection molded, compression molded, or extruded without additional processing.

This and additional objects of the invention are accomplished by mixing electrically conductive particles or strands into a piezoelectric matrix material. The electrically conductive particles or strands act as small localized electrical short-circuits within the matrix material and effectively dissipate the electric charges produced by piezoelectric effect from the pressure of acoustic or vibrational energy as heat. All energy thus converted into heat is subtracted from the original acoustic or vibrational energy, resulting in acoustic absorption and/or vibration damping.

BRIEF DESCRIPTION OF THE DRAWINGS

In the following Description of the Preferred Embodiments and the accompanying drawings, like numerals in different figures represent the same structures or elements. The representation in each of the figures is diagrammatic and no attempt is made to indicate actual scales or precise ratios. Proportional relationships are shown as approximations.

DESCRIPTION OF THE PREFERRED EMBODIMENTS

The parts indicated on the drawings by numerals are identified below to aid in the reader's understanding of the present invention.

10. Piezoelectric matrix material.

11. Electrically conductive particle.

12. Electrically conductive strand.

Figure 1:
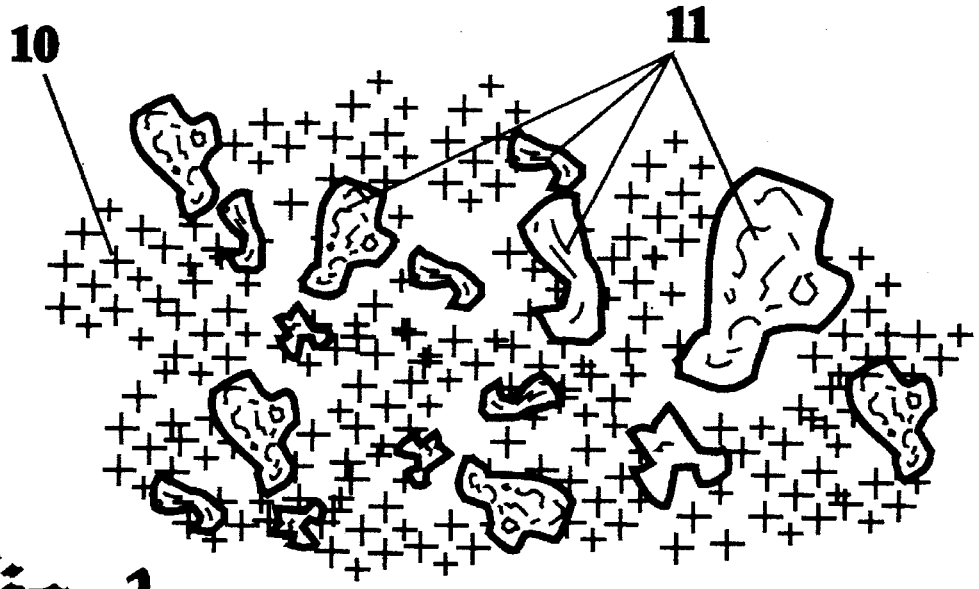
FIG. 1 shows a shows a piezoelectric matrix material of the instant invention with a plurality of embedded electrically conductive particles.

A preferred embodiment of the instant invention is shown in FIG. 1 with electrically conductive particles. In FIG. 1, 10 is the piezoelectric matrix material of the instant invention and may be any piezoelectrically active material. A preferred piezoelectric matrix material is polyvinylidene fluoride (PVDF). The electrically conductive particles, 11, of FIG. 1 are randomly distributed within the piezoelectric matrix material, 10, and act as electrical short-circuits for the piezoelectrically active matrix material. Current flowing in the electrically conductive particles, 11, will cause them to heat due to their resistance. The heat produced in the electrically conductive particles will be dissipated into the piezoelectric matrix material but will have no specific orientation relative to the propagation direction of the acoustic or vibrational energy that produced the electricity that causes heating. That is, the molecular movement of the heat that results indirectly from the piezoelectric effect of the matrix material is random and, additionally, somewhat phase-delayed due to the thermal inertia of the electrically conductive particles. Thus, the correlated molecular movement of propagating acoustic or vibrational energy within the piezoelectric matrix material of the instant invention is decorrelated into heat. A preferred material for the electrically conductive particles is graphite.

Figure 2:
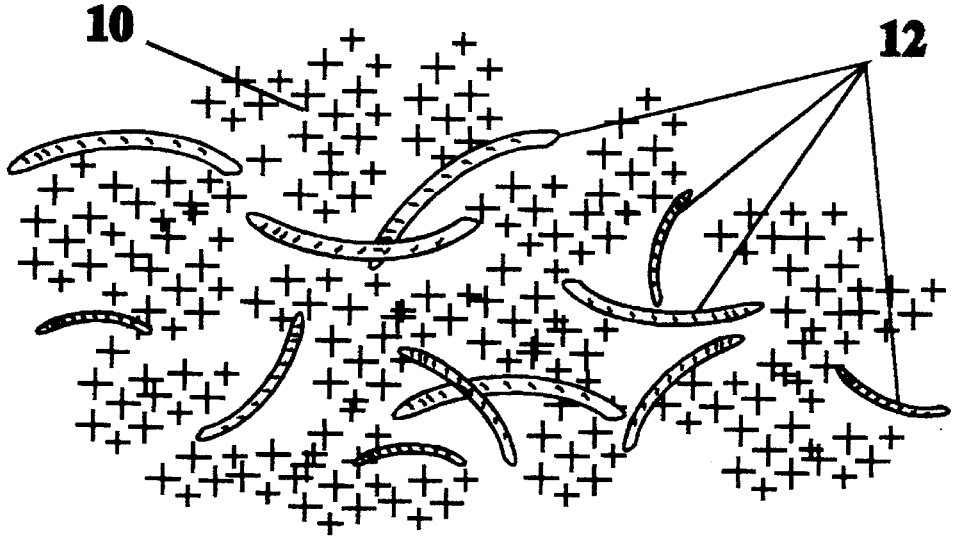
FIG. 2 shows a piezoelectric matrix material of the instant invention with a plurality of embedded electrically conductive strands.

A preferred embodiment of the instant invention is shown in FIG. 2 with electrically conductive strands. In FIG. 2, 10 is the piezoelectric matrix material of the instant invention and may be any piezoelectrically active material. A preferred piezoelectric matrix material is polyvinylidene fluoride (PVDF). The electrically conductive strands, 12, of FIG. 2 are randomly distributed within the piezoelectric matrix material, 10, and act as electrical short-circuits for the piezoelectrically active matrix material. Current flowing in the electrically conductive strands, 12, will cause them to heat due to their resistance. The heat produced in the electrically conductive strands will be dissipated into the piezoelectric matrix material but will have no specific orientation relative to the propagation direction of the acoustic or vibrational energy that produced the electricity that causes heating. That is, the molecular movement of the heat that results indirectly from the piezoelectric effect of the matrix material is random and, additionally, somewhat phase-delayed due to the thermal inertia of the electrically conductive particles. Thus, the correlated molecular movement of propagating acoustic or vibrational energy within the piezoelectric matrix material of the instant invention is decorrelated into heat. A preferred material for the electrically conductive strands is graphite.

Many modifications and variations of the present invention are possible in light of the above teachings. For example, any matrix material with piezoelectric activity may be used and any electrically conductive particles, strands, or long fibers, may also be used. It is therefore to be understood that, within the scope of the appended claims, the instant invention may be practiced otherwise than as specifically described.

I claim:

1. An acoustic absorption or vibration damping material comprised of a piezoelectrically active matrix material with a plurality of electrically conductive particles incorporated and embedded therein such that said electrically conductive particles are substantially encapsulated and enclosed within and by said piezoelectrically active matrix material.

2. The acoustic absorption or vibration damping material of claim 1 where said matrix material is polyvinylidene fluoride.

3. The acoustic absorption or vibration damping material of claim 1 where said electrically conductive particles are made from graphite.

4. The acoustic absorption or vibration damping material of claim 1 where said electrically conductive particles are made from a metal.

5. An acoustic absorption or vibration damping material comprised of a piezoelectrically active matrix material with a plurality of electrically conductive strands incorporated and embedded therein such that said electrically conductive strands are substantially encapsulated and enclosed within and by said piezoelectrically active matrix material.

6. The acoustic absorption or vibration damping material of claim 5 where said matrix material is polyvinylidene fluoride.

7. The acoustic absorption or vibration damping material of claim 5 where said electrically conductive strands are made from graphite.

8. The acoustic absorption or vibration damping material of claim 5 where said electrically conductive strands are made from a metal.

9. The acoustic absorption or vibration damping material of claim 5 where said electrically conductive strands are long fibers.

* * * * *